US009834340B2

(12) United States Patent
Myer

(10) Patent No.: US 9,834,340 B2
(45) Date of Patent: Dec. 5, 2017

(54) TAMPER EVIDENT AND RESISTANT CONTAINER

(71) Applicant: Dart Container Corporation, Mason, MI (US)

(72) Inventor: Wayne J. Myer, Mason, MI (US)

(73) Assignee: Dart Container Corporation, Mason, MI (US)

( * ) Notice: Subject to any disclaimer, the term of this patent is extended or adjusted under 35 U.S.C. 154(b) by 9 days.

(21) Appl. No.: 14/635,590

(22) Filed: Mar. 2, 2015

(65) Prior Publication Data

US 2016/0257453 A1 Sep. 8, 2016

(51) Int. Cl.
*B65D 43/02* (2006.01)
*B65D 43/16* (2006.01)

(52) U.S. Cl.
CPC ..... *B65D 43/0239* (2013.01); *B65D 43/0241* (2013.01); *B65D 43/162* (2013.01); *B65D 2101/0015* (2013.01); *B65D 2203/12* (2013.01); *B65D 2251/20* (2013.01); *B65D 2543/0037* (2013.01); *B65D 2543/0049* (2013.01); *B65D 2543/00092* (2013.01); *B65D 2543/00296* (2013.01); *B65D 2543/00462* (2013.01); *B65D 2543/00472* (2013.01); *B65D 2543/00509* (2013.01); *B65D 2543/00537* (2013.01); *B65D 2543/00555* (2013.01); *B65D 2543/00657* (2013.01); *B65D 2543/00685* (2013.01);

(Continued)

(58) Field of Classification Search
CPC ..... B65D 43/0239; B65D 2101/0015; B65D 2203/12; B65D 2543/00092; B65D 2543/00462
See application file for complete search history.

(56) References Cited

U.S. PATENT DOCUMENTS 4,027,775 A 6/1977 Mygatt, Jr. et al.
4,385,711 A 5/1983 Bowen
(Continued)

FOREIGN PATENT DOCUMENTS

AU 760789 B2 5/2003
EP 0628492 A1 12/1994
(Continued)

OTHER PUBLICATIONS

European Search Report for Counterpart EP16155246.8, dated Jul. 4, 2016.

(Continued)

*Primary Examiner* — J. Gregory Pickett
*Assistant Examiner* — James Way
(74) *Attorney, Agent, or Firm* — McGarry Bair PC

(57) ABSTRACT

A container having tamper evident and resistant features includes a tray, a cover, and a blocking wall that prevents direct access to a peripheral cover lip of the cover when the cover is in a closed position on the tray. The container includes at least one tab that prevents direct access to the peripheral cover lip and which is at least partially separable from the container along at least one line of weakness to provide access to the peripheral cover lip for removing the cover from the tray. The tab further includes an interference element that inhibits replacement of the tab into its original position with respect to the container after the at least one line of weakness have been severed.

48 Claims, 6 Drawing Sheets

(52) U.S. Cl.
CPC ..... *B65D 2543/00768* (2013.01); *B65D 2543/00796* (2013.01); *B65D 2543/00842* (2013.01)

(56) References Cited

U.S. PATENT DOCUMENTS

| | | | | |
|---|---|---|---|---|
| 4,474,305 | A | 10/1984 | Marco | |
| 4,520,943 | A * | 6/1985 | Nielsen | B65D 21/0233 220/281 |
| 4,762,248 | A | 8/1988 | Uhlig | |
| 4,819,824 | A | 4/1989 | Longbottom et al. | |
| 5,027,969 | A | 7/1991 | Lequir | |
| 5,170,905 | A | 12/1992 | Luch | |
| 5,219,087 | A * | 6/1993 | Christensson | B65D 55/06 220/266 |
| 5,249,694 | A | 10/1993 | Nelson | |
| 5,398,836 | A * | 3/1995 | Luch | B29C 57/12 220/270 |
| 5,437,386 | A * | 8/1995 | Von Holdt | B65D 43/0206 220/268 |
| 5,507,406 | A | 4/1996 | Urciuoli et al. | |
| 5,573,134 | A * | 11/1996 | Chenault | B29C 57/12 215/250 |
| 5,931,332 | A * | 8/1999 | Mygatt | B65D 1/00 220/270 |
| 7,946,441 | B2 * | 5/2011 | Habitz | B65D 43/0218 215/256 |
| 8,056,750 | B2 * | 11/2011 | Vovan | B65D 43/021 220/266 |
| 8,127,961 | B2 * | 3/2012 | Vovan | B65D 43/0206 220/212 |
| 8,146,766 | B2 | 4/2012 | Vovan et al. | |
| 8,186,531 | B2 | 5/2012 | Parikh et al. | |
| 8,701,919 | B2 * | 4/2014 | Messier | B65D 43/162 220/266 |
| 2006/0016821 | A1 | 1/2006 | Liu | |
| 2009/0120937 | A1 | 5/2009 | Vovan | |
| 2009/0120942 | A1 * | 5/2009 | Vovan | B65D 43/0239 220/574.1 |
| 2013/0098914 | A1 | 4/2013 | Pudselykke | |
| 2013/0168394 | A1 * | 7/2013 | Messier | B65D 43/162 220/266 |

FOREIGN PATENT DOCUMENTS

| | | | |
|---|---|---|---|
| EP | 1201555 | A2 | 5/2002 |
| EP | 2437982 | B1 | 1/2014 |
| FR | 2811638 | A1 | 1/2002 |
| JP | 2009132414 | A | 6/2009 |
| WO | 9627534 | A1 | 9/1996 |

OTHER PUBLICATIONS

European Search Report for Counterpart EP17156958.5, dated June 8, 2017.

* cited by examiner

TAMPER EVIDENT AND RESISTANT CONTAINER

BACKGROUND

Disposable containers for packaging and storing edible goods are often provided with tamper resistant and tamper evident features to prevent unauthorized access to the interior of the container and to indicate to a consumer when the container has previously been opened. That the consumer still finds it desirable to have the tamper evident and resistant features in combination with a resealable container increases the complexity of the container, which may make it more difficult and time consuming to open.

BRIEF DESCRIPTION

According to one embodiment, a container comprises a tray, a cover comprising a top wall terminating in a cover rib having a peripheral cover lip, a blocking wall preventing direct access to the peripheral cover lip when the cover is on the tray in a closed position on the open top of the tray, and at least one tab that prevents direct access to the peripheral cover lip and which is at least partially separable from the container along at least one line of weakness to provide access to the peripheral cover lip for removing the cover from the tray. The at least one tab further includes an interference element that inhibits replacement of the tab into its original position with respect to the container after the at least one line of weakness have been severed.

DESCRIPTION OF AN EMBODIMENT OF THE INVENTION

Figure 2:
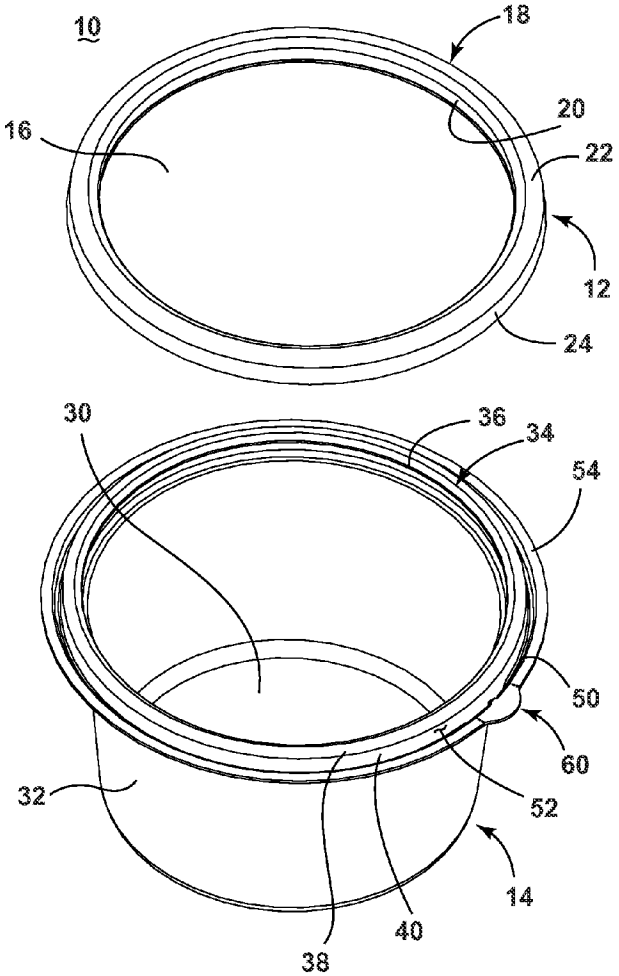
FIG. 2 is an exploded view of the container of FIG. 1 according to an embodiment of the invention.
Figure 1:
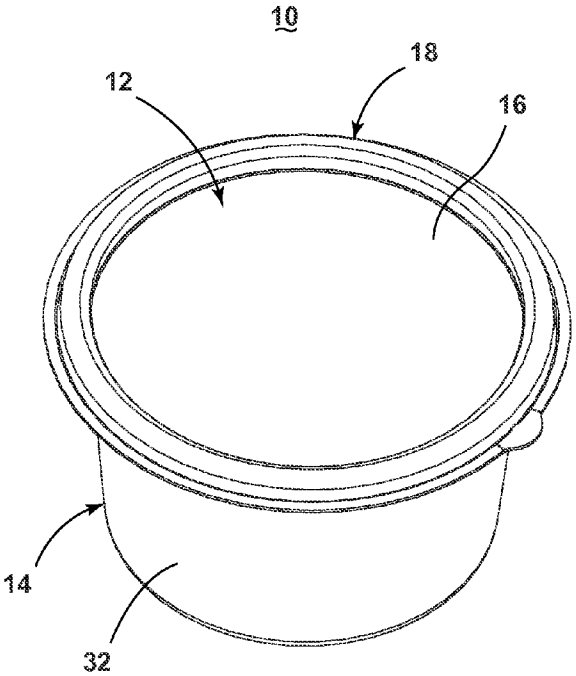
FIG. 1 is a perspective view of a container having a cover mounted to a tray in a closed position according to an embodiment of the invention.

FIGS. 1 and 2 illustrate a container 10 comprising a cover 12 and a tray 14. Non-limiting examples of suitable materials for the container 10 include oriented polystyrene, polypropylene and polyethylene terephthalate. All or a portion of the container 10 can be formed so as to be translucent, transparent, opaque or a combination thereof. While the container 10 is illustrated as having a generally circular shape, the container 10 can have any geometric shape, non-limiting examples of which include square, rectangular, oval, octagonal, and hexagonal.

Referring now to FIG. 2, the cover 12 includes a top wall 16 defining a plane. References to above/below the plane are made with respect to the cover 12 in a closed position, as illustrated in FIG. 1. References to inward/outward are made with respect to central axis of the container 10. The cover 12 includes a top wall 16 terminating in a cover rib 18 that extends around the perimeter of the top wall 16. The cover rib 18 can include a cover rib inner wall 20 extending from the top wall 16 and connected with a peripheral cover lip 24 by a cover rib top wall 22. In the embodiment of FIG. 2, the cover rib 18 is illustrated as having a generally U-shaped cross-section, although it is within the scope of the invention for the cover rib 18 to have an alternative cross-sectional shape.

Figure 3:
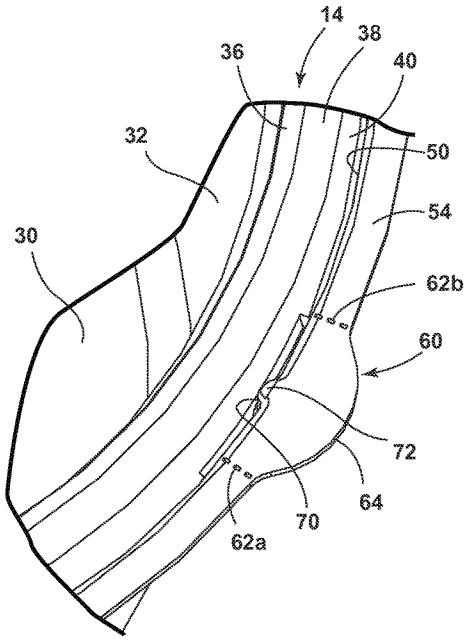
FIG. 3 is a perspective view of a portion of the tray of FIG. 2 according to an embodiment of the invention.

As illustrated in FIGS. 2 and 3, the tray 14 includes a bottom wall 30 from which extends a peripheral side wall 32 which terminates in a tray rib 34 that at least partially defines an open top providing access to the interior compartment of the container defined by the bottom 30 and the peripheral side wall 32. In the embodiment of FIGS. 2 and 3, the tray rib 34 includes a tray rib inner wall 36 extending from the peripheral side wall 32 and connected with a tray rib outer wall 40 by a tray rib top wall 38 such that the tray rib 34 has a generally U-shaped cross-section, although it is within the scope of the invention for the tray rib 34 to have a different cross-sectional shape. The tray rib 34 can also be provided with a blocking wall 50 that is either part of the tray rib 34 or a separate structure. The blocking wall 50 can be spaced from the tray rib outer wall 40 by a gap 52. The blocking wall 50 can optionally include a flange 54 which can define the exterior perimeter of the container 10 or the blocking wall 50 can include additional structural features, such as a downwardly depending skirt, or no additional structural features without deviating from the scope of the invention.

The blocking wall 50 can be provided with at least one tab 60 that can form a portion of the blocking wall 50 (as illustrated) or be separated from the blocking wall 50. The tab 60 is configured so as to be at least partially separable from the container 10 along at least one line of weakness. In the embodiment of FIGS. 2 and 3, the tab 60 is coupled with the blocking wall 50 along two lines of weakness 62*a*, 62*b*. While two lines of weakness 62*a*, 62*b* are illustrated, it will be understood that the tab 60 can be defined by a single line of weakness or more than two lines of weakness. The lines of weakness can be in the form of a score line or a series of perforations configured to allow the tab 60 to be separated from the blocking wall 50 along the lines of weakness 62*a*, 62*b*. Alternatively, the lines of weakness 62*a*, 62*b* can be formed from a series of alternating rounded crests and troughs of narrowed thickness or areas of removed material. The lines of weakness 62*a*, 62*b* can extend around a portion of the tab 60 such that the tab 60 is only partially removed from the blocking wall 50 and remains attached to the container 10 when the lines of weakness 62*a*, 62*b* are severed. Alternatively, the lines of weakness 62*a*, 62*b* can extend around the entire perimeter of the tab 60 such that the tab 60 is removed from the blocking wall 50 and the container 10 when the lines of weakness 62*a*, 62*b* are severed.

Figure 4:
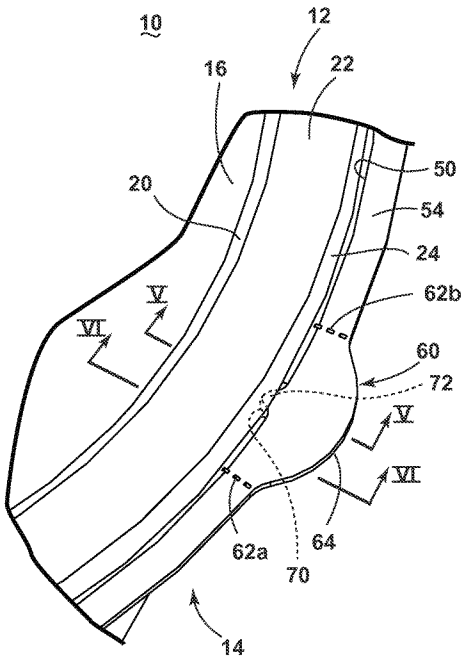
FIG. 4 is a perspective view of a portion of the container of FIG. 1 showing a tab provided on the tray in a first position according to an embodiment of the invention.

Referring now to FIGS. 3 and 4, the tab 60 can optionally include a projection 64 to facilitate grasping the tab 60 to separate the tab 60 from the blocking wall 50 along the lines of weakness 62*a*, 62*b*. The tab 60 further includes an interference element 70 extending from the tab 60 into the gap 52. The interference element 70 can extend partially into the gap 52, as illustrated, or span the entire distance of the gap 52. As illustrated in FIG. 4, when the cover 12 is in the closed position on the tray 14, the peripheral cover lip 24 is received within the gap 52 and engages the interference element 70 on the tab 60 when the tab 60 is in a first position corresponding to a position in which the tab 60 prevents direct access to the peripheral cover lip 24, which, in the embodiment of FIG. 4, corresponds to a position in which the tab 60 has not been separated from the blocking wall 50 along the lines of weakness 62*a*, 62*b*. When the cover 12 is in the closed position and the tab 60 is in the first position, the blocking wall 50 and the tab 60 inhibit access to the peripheral cover lip 24 and in this manner inhibit removal of the cover 12 from the tray 14 to open the container 10.

The tab 60 can be separated from the blocking wall 50 along the lines of weakness 62*a*, 62*b* such that the tab 60 can be moved into a second position to provide access to the peripheral cover lip 24 such that a consumer can grasp the peripheral cover lip 24 to remove the cover 12 from the tray 14. In this manner, separation of the tab 60 along the lines of weakness 62*a*, 62*b* provides an indication that the container 10 has been opened and thus provides an indication that the container 10 may have been tampered with. As used herein, providing an indication that the container 10 has been opened refers to indicating that the container 10 was in a condition in which the cover 12 could be removed from the tray 14 in the intended manner, regardless of whether the cover 12 was actually removed from the tray 14. The blocking wall 50 inhibits a consumer from opening the container 10 without destroying or damaging the blocking wall 50 and/or the peripheral cover lip 24 without using the tab 60 in the intended manner.

Figure 6:
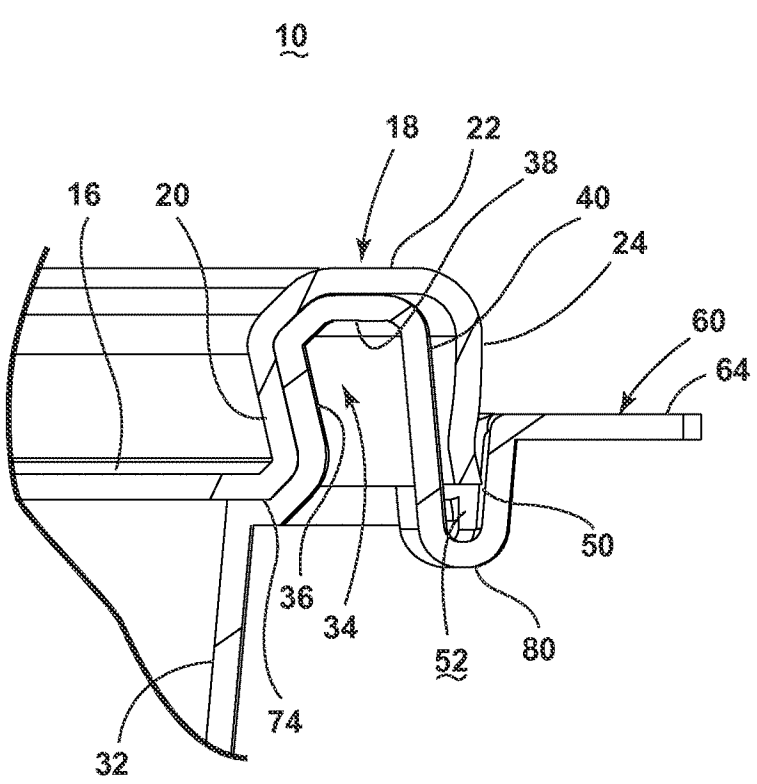
FIG. 6 is a partial cross-section of the container of FIG. 4 taken along the line VI-VI according to an embodiment of the invention.
Figure 5:
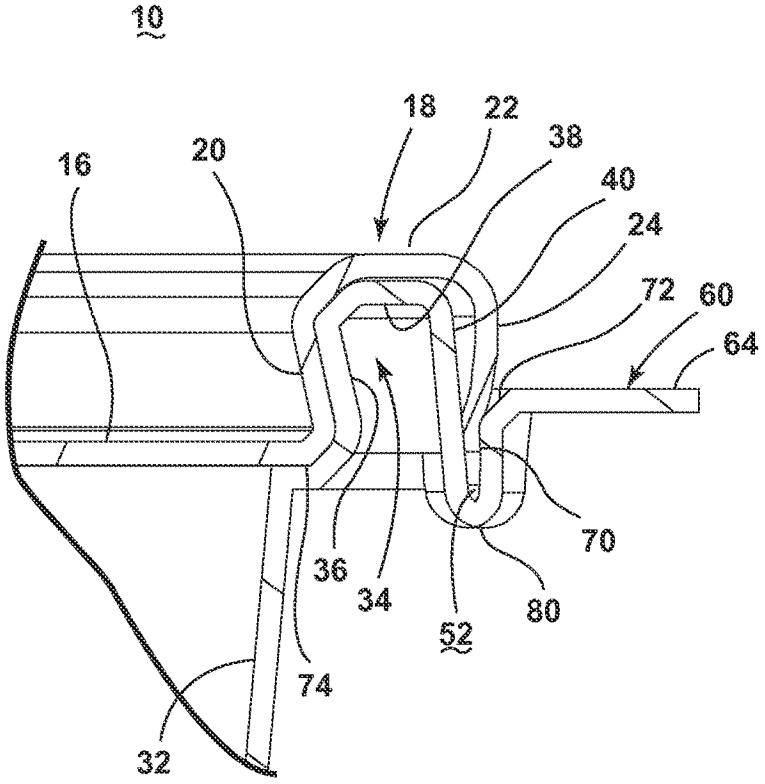
FIG. 5 is a partial cross-section of the container of FIG. 4 taken along the line V-V according to an embodiment of the invention.

Referring now to FIGS. 5 and 6, when the cover 12 is in the closed position and the tab 60 is in the first position, the peripheral cover lip 24 extends into the gap 52 between the blocking wall 50 and tab 60 and the tray rib outer wall 40, thus inhibiting direct access to the peripheral cover lip 24. The interference element 70 extends from the tab 60 into the gap 52 such that the interference element 70 engages the peripheral cover lip 24 through an interference fit. As can best be seen in FIG. 5, the interference element 70 engages and deflects the peripheral cover lip 24. It is also within the scope of the invention for there to be some deflection of the tab 60 and/or interference element 70 by the peripheral cover lip 24 depending on the extent to which the peripheral cover lip 24 and interference element 70 extend into the gap 52 and the relative strength of the peripheral cover lip 24 and the interference element 70/tab 60. The interference element 70 can be provided with an angled face 72 to facilitate deflecting the peripheral cover lip 24 as the cover 12 is positioned on the tray 14 and moved into the closed position.

The interference element 70 can be in the form of a vertical rib (as illustrated), a rounded protuberance, or have any other geometric cross-sectional shape. While the interference element 70 is illustrated as positioned in a central portion of the tab 60, it is within the scope of the invention for the interference element 70 to be positioned off-center with the respect to the tab 60. It is also within the scope of the invention for the tab 60 to include multiple interference elements 70.

The interference element 70 is configured of a size and shape to extend into the gap 52 to such an extent as to engage the peripheral cover lip 24 through an interference fit and deflect the peripheral cover lip 24. The width of the gap 52, the extent to which peripheral cover lip 24 extends into the gap 52, and the extent to which the peripheral cover lip 24 is deflected by the interference element 70 can be configured to inhibit direct access to the peripheral cover lip 24 while still allowing the cover 12 to be seated on the tray 14 in an initial closed condition prior to a first opening of the container 10 and prior to separation of the tab 60 along the lines of weakness 62*a*, 62*b*. As illustrated in FIG. 6, which is a partial cross-section through a portion of the container 10 that does not include the interference element 70, the peripheral cover lip 24 can have little to no engagement with the blocking wall 50 when the cover is in the closed condition.

Still referring to FIGS. 5 and 6, the cover rib 18 can have a generally U-shaped cross-section defined by the cover rib inner wall 20, top wall 22, and peripheral cover lip 24 that is configured to receive a correspondingly U-shaped tray rib 34 defined by the tray rib inner wall 36, top wall 38 and outer wall 40. The cover rib 18 can include a cover seal structure formed at least in part by the cover rib inner wall 20 and the tray rib 34 can include a tray seal structure formed at least in part by the tray rib inner wall 36 which engages the cover seal structure when the cover 12 is in the closed position to form a peripheral seal. In the embodiment of FIGS. 5 and 6, the perimeter of the tray 14 as defined by the tray rib inner wall 36 can be slightly smaller than the perimeter of the cover 12 as defined by the cover rib inner wall 20 to provide an interference fit between the tray rib inner wall 36 and the cover rib inner wall 20 to form the peripheral seal when the cover 12 is in the closed position. Additionally, or alternatively, the tray 14 can further include an inner tray flange 74 provided between the peripheral side wall 32 and the tray rib 34 to form a seat that engages a portion of the cover top wall 16 and the cover rib inner wall 20 through an interference fit to form a peripheral seal between the cover 12 and the tray 14. Non-limiting examples of a peripheral seal a liquid-tight peripheral seal and a liquid-resistant peripheral seal.

Figure 8:
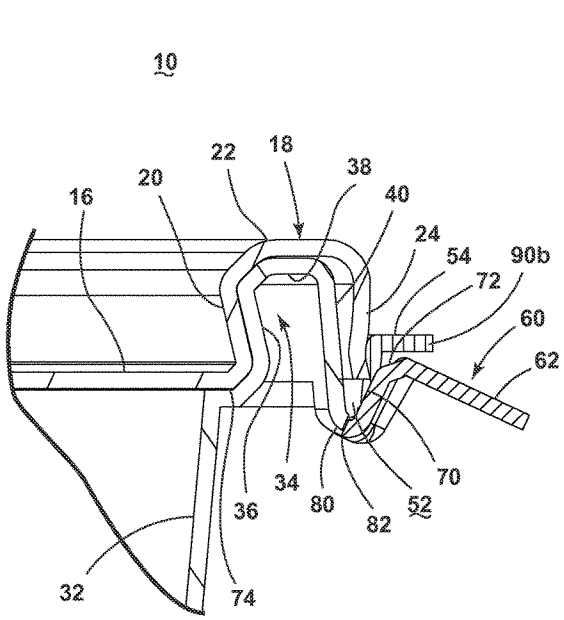
FIG. 8 is a partial cross-section of the container of FIG. 7 according to an embodiment of the invention.
Figure 7:
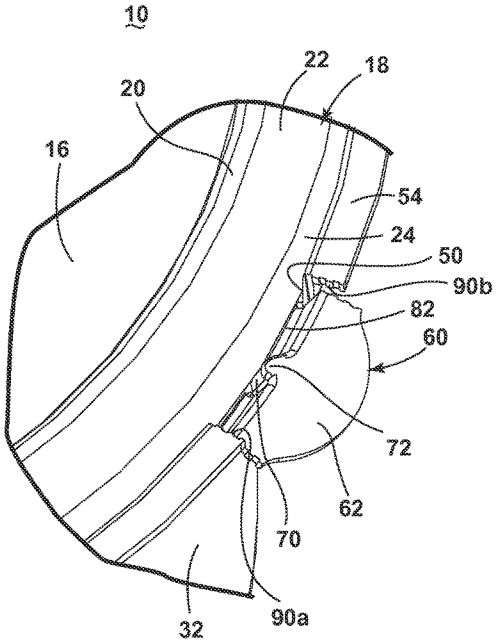
FIG. 7 is a perspective view of the container of FIG. 1 illustrating the tab in a second position according to an embodiment of the invention.

To open the container 10, a consumer separates the tab 60 from the blocking wall 50 along the lines of weakness 62*a*, 62*b*, as illustrated in FIGS. 7 and 8, to move the tab 60 from the first position to the second position to gain access to the peripheral cover lip 24. In the embodiment of FIGS. 7 and 8, the tab 60 is separable from the blocking wall 50 along parallel lines of weakness 62*a*, 62*b*, but remains connected with the container 10 at a tray outer flange 80 adjacent the blocking wall 50 by a living hinge 82. The living hinge 82 can be formed by scoring or thinning the material forming the living hinge 82. In this manner, after the lines of weakness 62*a*, 62*b* are severed, the tab 60 can be pivoted about the living hinge 82 away from the blocking wall 50 to provide access to the peripheral cover lip 24. The consumer can then grasp the exposed portion of the peripheral cover lip 24 and remove the cover 12 from the open top of the tray 14.

The dimensions of the tab 60, as defined by the spacing of the lines of weakness 62*a*, 62*b*, can be configured to provide sufficient space between first and second ends 90*a*, 90*b* of the blocking wall 50, formed when the lines of weakness 62*a*, 62*b* are severed, to allow a consumer to grasp enough of the peripheral cover lip 24 to overcome the peripheral seal between the cover 12 and tray 14 to remove the cover 12 from the tray 14. In addition, while the living hinge 82 is described as being formed in the tray outer flange 80, the living hinge 82 can be formed in the blocking wall 50 or within the tray rib outer wall 40 in a similar manner, as long as the positioning of the living hinge 82 is configured to allow the tab 60 to be pivoted into the second position such that the consumer can grasp the peripheral cover lip 24 in order to remove the cover 12 from the tray 14. Alternatively, the living hinge 82 can be configured as a line of weakness similar to the lines of weakness 62*a*, 62*b*, such that the tab 60 can be separated from the container 10 to provide access to the peripheral cover lip 24.

Movement of the tab 60 from the first position to the second position provides an indication that the container 10 has been opened and thus provides the container 10 with a tamper evident feature. The blocking wall 50 and the tab 60 inhibit a consumer from accessing the peripheral cover lip 24 to open the container 10 without destroying or damaging the blocking wall 50 and/or the peripheral cover lip 24. In this manner, the blocking wall 50 and tab 60 provide the container 10 with a tamper resistant feature in that the container 10 cannot be opened except in a manner which provides evidence that the container 10 has been opened.

Once the tab 60 is moved into the second position, as illustrated in FIGS. 7 and 8, the interference element 70 inhibits replacement of the tab 60 back into the first position. As illustrated in FIGS. 4 and 5, the interference element 70 is configured to extend into the gap 52 and deflect the peripheral cover lip 24 when the cover 12 is in the closed position. Once the tab 60 is separated from the blocking wall 50 along the lines of weakness 62*a*, 62*b*, the tab 60 does not have sufficient strength to deflect the peripheral cover lip 24 and thus the peripheral cover lip 24 will deflect the tab 60, preventing the tab 60 from being replaced into the first position after the lines of weakness 62*a*, 62*b* have been severed. The peripheral cover lip 24 and interference element 70 are configured such that there is at least some deflection of the peripheral cover lip 24 by the interference element 70 when the interference element 70 is in the first position such that once the tab 60 is severed along the lines of weakness 62*a*, 62*b* and the tab 60 is moved into the second position, the extent to which the peripheral cover lip 24 extends across the gap 52 and the dimensions of the interference element 70 inhibit re-positioning of the tab 60 back into the first position. Thus, it is possible that the peripheral cover lip 24 and the interference element 70, when the tab 60 is in the first position, are configured to extend across the gap 52 such that there is at least some deflection, either equal or unequal, of both the peripheral cover lip 24 and the interference element 70 and/or tab 60. Regardless of whether or not there is deflection of both the peripheral cover lip 24 and the interference element 70 and/or tab 60 when the tab 60 is in the first position, the peripheral cover lip 24 and interference element 70 are configured to extend into the gap 52 to inhibit re-positioning of the tab 60 back into the first position severing the lines of weakness 62*a*, 62*b* to move the tab 60 to the second position.

Without the interference element 70, it may be possible for the tab 60 to be re-positioned between the first and second ends 90*a*, 90*b* of the blocking wall 50 such that the tab 60 appears to be in the first position. In this scenario, it may not be evident to a consumer that the tab 60 has already been moved such that the cover 12 could be removed. The interference element 70 inhibits replacement of the tab 60 back into the first position after the container has been opened and enhances the visual indication provided by the tab 60 that the container 10 has been opened.

While the container 10 is illustrated as having a single tab 60, it is within the scope of the invention for the container 10 to include multiple tabs 60 providing more than one location by which the consumer can gain access to the peripheral cover lip 24.

Figure 10:
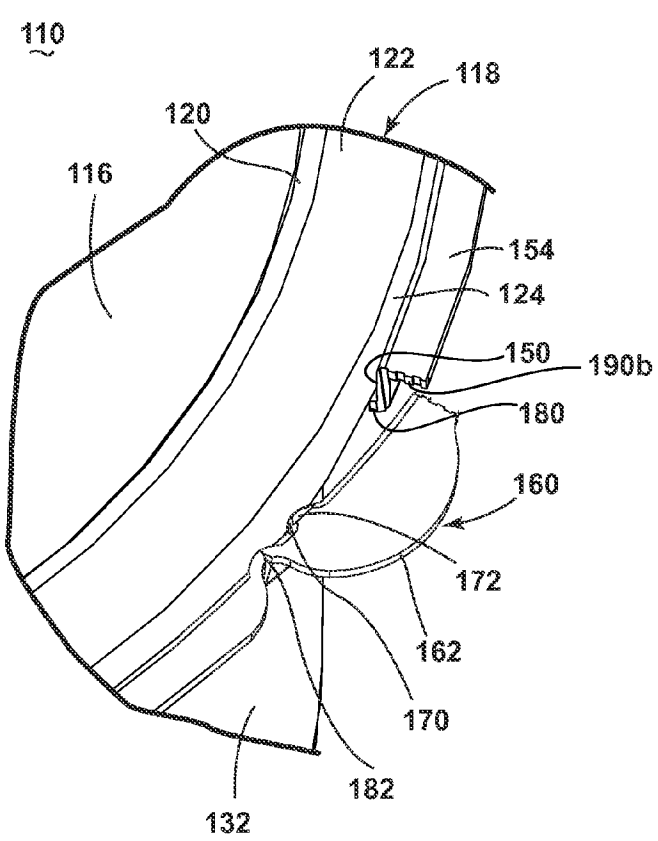
FIG. 10 is a perspective view of a portion of the container of FIG. 9 illustrating the tab in a second position according to an embodiment of the invention.
Figure 9:
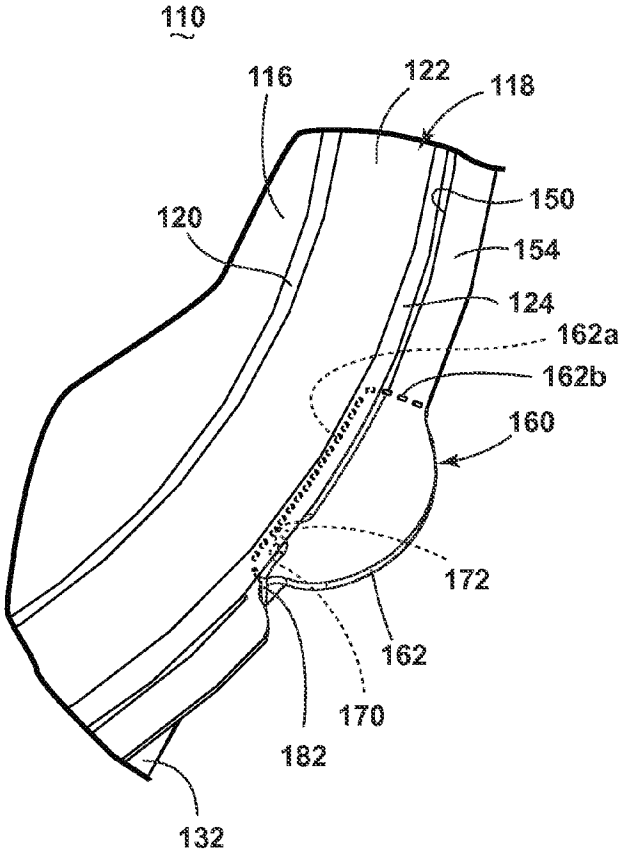
FIG. 9 is a perspective view of a portion of a container having a cover and a tray provided with a tab in a first position according to an embodiment of the invention.

FIGS. 9-10 illustrate another embodiment of the invention comprising a container 110, which is similar to the first container 10 except for the manner in which a tab 60 is formed. Therefore, elements in the container 110 similar to those of the container 10 will be numbered with the prefix 100.

The tab 160 is similar to the tab 60 except that the tab 160 is configured to pivot laterally rather than downward when the lines of weakness 162*a*, 162*b* are severed. While FIGS. 9 and 10 illustrate two lines of weakness 162*a*, 162*b*, it is within the scope of the invention for the tab 160 to be defined by a single line of weakness or more than two lines of weakness. In the container 110, the tab 160 is connected at one end to the blocking wall 150 by a line of weakness 162*b* and connected to the blocking wall 150 at an opposite end by a living hinge 182. The tab 160 can further be defined by an additional line of weakness 162*a* connecting the tab 160 to the tray outer flange 180. In this manner, the tab 160 can be separated from the blocking wall 150 at one end and along a bottom edge and pivoted laterally about the living hinge 182 to provide access to the peripheral cover lip 124 to open the container 110 in the same manner as described above for the container 10.

The tab 160 also includes the interference element 170 which inhibits the tab 160 from being re-positioned back into the first position after the lines of weakness 162*a*, 16*b* are severed. In the embodiment of FIGS. 9 and 10, the interference element 170 can be positioned off-center with respect to the tab 160 such that the interference element 170 is adjacent to the living hinge 182. Positioning the interference element 170 adjacent the living hinge 182 limits the extent to which the tab 160 can be moved back towards the first position; the farther away from the living hinge 182 the interference element 170 is positioned, the further the tab 160 can be moved back towards the first position before being deflected by the peripheral cover lip 124.

Figure 11:
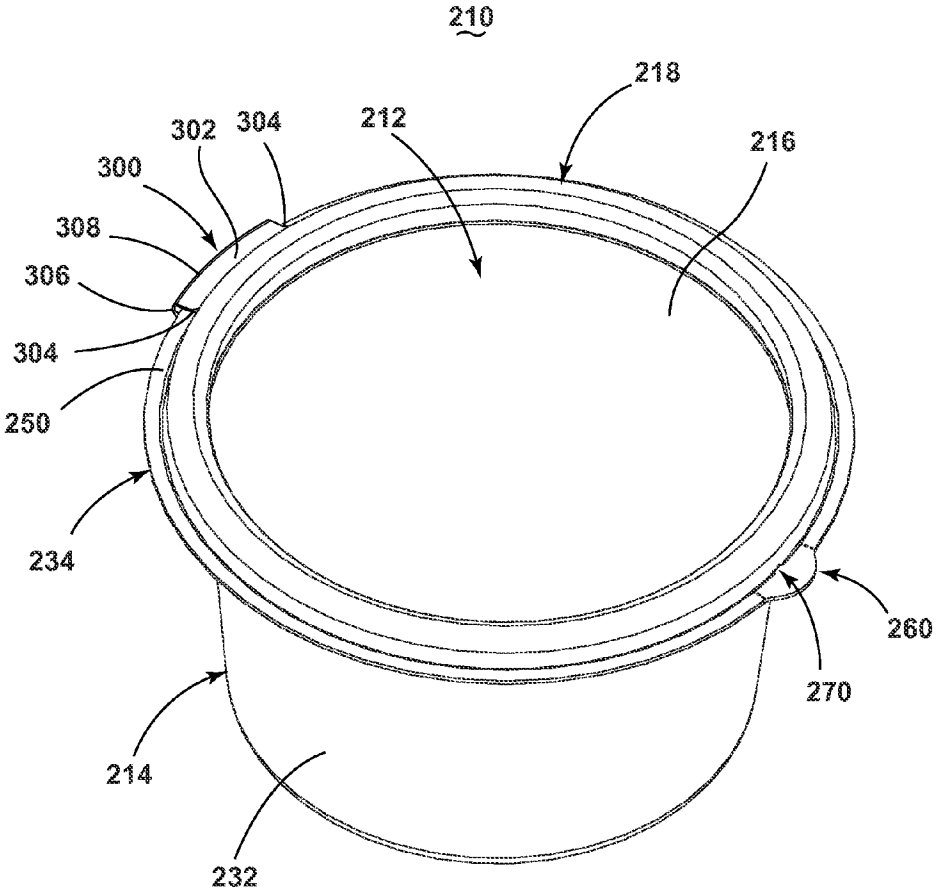
FIG. 11 is a perspective view of a hinged container having a cover mounted to a tray in a closed position according to an embodiment of the invention

FIG. 11 illustrates another embodiment of the invention comprising a container 210, which is similar to the first container 10 except for the manner in which the cover 212 is connected with the tray 214. Therefore, elements in the container 210 similar to those of the container 10 will be numbered with the prefix 200.

As illustrated in FIG. 11, a hinge 300 can be provided to connect the cover 212 and the tray 214. A cover flange 302 can extend from a portion of the cover rib 218 between first and second ends 304 in the blocking wall 250 and be connected with a tray flange 306 extending from a portion of the tray rib 234 by a hinge line 308 that forms a hinge axis about which the cover 212 and tray 214 relatively rotate to move the container 10 between the opened and closed positions. The container 210 can be opened in the same manner as described above with respect to the container 10 and the blocking wall 250 provides a tamper resistant feature while the tab 260 and interference element 270 provide tamper evident features in the same manner as described above with respect to the container 10. The hinge 300 can include a single hinge line 308, as illustrated, or multiple hinge lines. It is also within the scope of the invention for the hinge 300 to include at least one line of weakness such that the cover 212 can be separated from the tray 214 along the at least one line of weakness. It is also within the scope of the invention for the tab 260 to be provided on the hinge 300.

The embodiments of the invention described herein provide a container 10, 110, 210 which is tamper resistant and also provides evidence to a consumer when tampering or attempts at tampering have occurred. The blocking wall 50, 150, 250 inhibits a consumer from opening the container 10, 110, 210 without destroying or damaging the blocking wall 50, 150, 250 and/or the peripheral cover lip 24, 124, 224 without using the tab 60, 160, 260 in the intended manner. The tab 60, 160, 260 is configured to be movable with respect to the blocking wall 50, 150, 250 to provide access to the peripheral cover lip 24, 124, 224 to remove the cover 12, 112, 212 from the tray 14, 114, 214 while also providing a visual indication that the container 10, 110, 210 has been opened. The interference element 70, 170, 270 enhances the visual indication that the container 10, 110, 210 has been opened by inhibiting replacement of the tab 60, 160, 260 back into a position in which it appears that the container 10, 110, 210 has not been opened. The tab 60, 160, 260 is configured such that once the container 10, 110, 210 has been opened and the cover 12, 112, 212 has been removed, the cover 12, 112, 212 can be replaced and re-sealed with the tray 14, 114, 214 while still providing visual evidence to a consumer that the container 10, 110, 210 has already been opened.

To the extent not already described, the different features and structures of the various embodiments of the container 10, 110, and 210 may be used in combination with each other as desired. That one feature may not be illustrated in all of the embodiments is not meant to be construed that it cannot be, but is done for brevity of description. Thus, the various features of the different embodiments of the containers 10, 110, and 210 may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A container comprising:

a tray comprising a bottom wall and a peripheral side wall extending upwardly from the bottom wall, which collectively define a compartment, and terminating in a tray rib to at least partially define an open top providing access to the compartment;

a cover comprising a top wall terminating in a cover rib having a peripheral cover lip;

a blocking wall provided with the tray rib and preventing direct access to the peripheral cover lip when the cover is on the tray in a closed position on the open top of the tray; and at least one tab included with the blocking wall and partially separable from the container along at least one line of weakness, wherein the at least one tab is moveable from a first position, where the at least one tab prevents direct access to the peripheral cover lip, and a second position, where the at least one tab is at least partially separated from the container along the at least one line of weakness to provide access to the peripheral cover lip;

an interference element extending from the at least one tab and engaging the peripheral cover lip through an interference fit when the cover is in an initial closed position, free from a force from a user, prior to the at least partial separation of the at least one tab from the container, wherein the peripheral cover lip is deflected by the interference element when the cover is in the initial closed position;

wherein the at least partial separation of the at least one tab from the container along the at least one line of weakness provides an indication that the cover has been removed from the tray to provide access to the compartment and wherein the interference element inhibits re-positioning of the at least one tab into the first position after movement of the at least one tab to the second position.

2. The container of claim 1 wherein the at least one tab is pivotable relative to the blocking wall.

3. The container of claim 1 wherein the at least one tab remains at least partially connected with the container when the at least one line of weakness is severed.

4. The container of claim 1 wherein the at least one tab is capable of being removed from the container when the at least one line of weakness is severed.

5. The container of claim 1 wherein the at least one line of weakness comprises perforations, score lines, areas of removed material, a series of crests and troughs of narrowed thickness, or combinations thereof.

6. The container of claim 1 wherein the blocking wall is spaced from an outer wall of the tray rib by a gap and the peripheral cover lip is received within the gap when the cover is in the closed position.

7. The container of claim 6 wherein the interference element extends from the at least one tab into the gap to deflect the peripheral cover lip when the cover is in the initial closed position and the tab is in the first position.

8. The container of claim 1 wherein the tray rib comprises a tray seal structure and the cover rib comprises a cover seal structure that engages the tray seal structure when the cover is in the closed position to form a peripheral seal.

9. The container of claim 1 wherein the at least one tab includes a projection to facilitate grasping the at least one tab to move the at least one tab from the first position to the second position.

10. The container of claim 1 wherein the interference element comprises a rib or a rounded protuberance.

11. The container of claim 1 wherein the interference element comprises an angled face to facilitate deflection of the peripheral cover lip during placement of the cover on the tray into the initial closed position.

12. The container of claim 1 wherein a perimeter of the tray and the cover comprises a circular, rectangular, square, or oval shape.

13. The container of claim 1, further comprising a hinge defining a hinge axis and connecting the tray and the cover for relative rotation about the hinge axis between the closed position and an opened position.

14. The container of claim 1 wherein the interference element is located in a central portion of the tab.

15. The container of claim 1 wherein the interference element is offset from a central portion of the tab.

16. The container of claim 1 wherein the at least one tab forms a portion of the blocking wall.

17. The container of claim 1 wherein the peripheral cover lip deflects the interference element and/or the at least one tab when the cover is in the initial closed position.

18. A container having tamper evident and tamper resistant features comprising:

a tray comprising a bottom wall and a peripheral side wall extending upwardly from the bottom wall, which collectively define a compartment, and terminating in a U-shaped tray rib to at least partially define an open top providing access to the compartment;

a cover comprising a top wall and terminating in a U-shaped cover rib that is configured to mate with the U-shaped tray rib when the cover is in a closed position on the open top of the tray, the cover rib further comprising a peripheral cover lip; and a blocking wall provided with the tray rib, the tray rib further including an outer wall connected with the blocking wall by a tray flange to define a gap between the blocking wall and the outer wall that receives the peripheral cover lip when the cover is in the closed position, the blocking wall preventing direct access to the peripheral cover lip when the cover is in the closed position;

at least one tab included with the blocking wall and partially separable from the container along at least one line of weakness, wherein the at least one tab is moveable from a first position, where the at least one tab prevents direct access to the peripheral cover lip, and a second position, where the at least one tab is at least partially separated from the container along the at least one line of weakness to provide access to the peripheral cover lip; and an interference element extending from the at least one tab into the gap to engage the peripheral cover lip through an interference fit when the cover is in an initial closed position, free from a force from a user, prior to the at least partial separation of the at least one tab from the container, wherein the peripheral cover lip is deflected by the interference element when the cover is in the initial closed position;

wherein the at least partial separation of the at least one tab from the blocking wall along the at least one line of weakness provides an indication that the cover has been removed from the tray to provide access to the compartment and wherein the interference element inhibits re-positioning of the at least one tab into the first position after movement of the at least one tab into the second position.

19. The container of claim 18 wherein the at least one tab is pivotable relative to the blocking wall.

20. The container of claim 18 wherein the at least one tab remains at least partially connected with the container when the at least one line of weakness is severed.

21. The container of claim 18 wherein the at least one tab is capable of being removed from the container when the at least one line of weakness is severed.

22. The container of claim 18 wherein the at least one line of weakness comprises perforations, score lines, areas of removed material, a series of crests and troughs of narrowed thickness, or combinations thereof.

23. The container of claim 18 wherein the tray rib comprises a tray seal structure and the cover rib comprises a cover seal structure that engages the tray seal structure when the cover is in the closed position to form a peripheral seal.

24. The container of claim 18 wherein the at least one tab includes a projection to facilitate grasping the at least one tab to move the at least one tab from the first position to the second position.

25. The container of claim 18 wherein the interference element comprises a rib or a rounded protuberance.

26. The container of claim 18 wherein the interference element comprises an angled face to facilitate deflection of the peripheral cover lip during placement of the cover on the tray into the initial closed position.

27. The container of claim 18 wherein a perimeter of the tray and the cover comprises a circular, rectangular, square, or oval shape.

28. The container of claim 18, further comprising a hinge defining a hinge axis and connecting the tray and the cover for relative rotation about the hinge axis between the closed position and an opened position.

29. The container of claim 18 wherein the interference element is located in a central portion of the tab.

30. The container of claim 18 wherein the interference element is offset from a central portion of the tab.

31. The container of claim 18 wherein the at least one tab forms a portion of the blocking wall.

32. The container of claim 18 wherein the peripheral cover lip deflects the interference element and/or the at least one tab when the cover is in the initial closed position.

33. A container comprising:

a tray comprising a bottom wall and a peripheral side wall extending upwardly from the bottom wall, which collectively define a compartment, and terminating in a tray rib to at least partially define an open top providing access to the compartment;

a cover comprising a top wall terminating in a cover rib having a peripheral cover lip;

a blocking wall provided with the tray rib and preventing direct access to the peripheral cover lip when the cover is on the tray in a closed position on the open top of the tray, the blocking wall including at least one tab that is partially separable from the container along at least one line of weakness, wherein the at least one tab is moveable from a first position, where the at least one tab prevents direct access to the peripheral cover lip, and a second position, where the at least one tab is at least partially separated from the blocking wall along the at least one line of weakness to provide access to the peripheral cover lip; and an interference element extending from the at least one tab and engaging the peripheral cover lip through an interference fit when the cover is in an initial closed position, free from a force from a user, prior to the at least partial separation of the at least one tab from the blocking wall, wherein the peripheral cover lip is deflected by the interference element when the cover is in the initial closed position;

wherein the at least partial separation of the at least one tab from the blocking wall along the at least one line of weakness provides an indication that the cover has been removed from the tray to provide access to the compartment and wherein the interference element inhibits re-positioning of the at least one tab into the first position after movement of the at least one tab to the second position.

34. The container of claim 33 wherein the at least one tab is pivotable relative to the blocking wall.

35. The container of claim 33 wherein the at least one tab remains at least partially connected with the blocking wall when the at least one line of weakness is severed.

36. The container of claim 33 wherein the at least one tab is capable of being removed from the blocking wall when the at least one line of weakness is severed.

37. The container of claim 33 wherein the at least one line of weakness comprises perforations, score lines, areas of removed material, a series of crests and troughs of narrowed thickness, or combinations thereof.

38. The container of claim 33 wherein the blocking wall is spaced from an outer wall of the tray rib by a gap and the peripheral cover lip is received within the gap when the cover is in the closed position.

39. The container of claim 38 wherein the interference element extends from the at least one tab into the gap to deflect the peripheral cover lip when the cover is in the initial closed position and the tab is in the first position.

40. The container of claim 33 wherein the tray rib comprises a tray seal structure and the cover rib comprises a cover seal structure that engages the tray seal structure when the cover is in the closed position to form a peripheral seal.

41. The container of claim 33 wherein the at least one tab includes a projection to facilitate grasping the at least one tab to move the at least one tab from the first position to the second position.

42. The container of claim 33 wherein the interference element comprises a rib or a rounded protuberance.

43. The container of claim 33 wherein the interference element comprises an angled face to facilitate deflection of the peripheral cover lip during placement of the cover on the tray into the initial closed position.

44. The container of claim 33 wherein a perimeter of the tray and the cover comprises a circular, rectangular, square, or oval shape.

45. The container of claim 33, further comprising a hinge defining a hinge axis and connecting the tray and the cover for relative rotation about the hinge axis between the closed position and an opened position.

46. The container of claim 33 wherein the interference element is located in a central portion of the tab.

47. The container of claim 33 wherein the interference element is offset from a central portion of the tab.

48. The container of claim 33 wherein the peripheral cover lip deflects the interference element and/or the at least one tab when the cover is in the initial closed position.

* * * * *